US006415731B2

(12) United States Patent
Chrunyk

(10) Patent No.: US 6,415,731 B2
(45) Date of Patent: Jul. 9, 2002

(54) METHOD OF CONTROLLING THE ATTITUDE OF A BOAT AT HIGH SPEED THROUGH BOAT HULL DESIGN AND A BOAT HULL

(76) Inventor: Rob Chrunyk, Box 640, Penhold, Alberta (CA), T0M 1R0

( * ) Notice: Subject to any disclaimer, the term of this patent is extended or adjusted under 35 U.S.C. 154(b) by 0 days.

(21) Appl. No.: 09/871,098

(22) Filed: May 31, 2001

(30) Foreign Application Priority Data

Jun. 1, 2000 (CA) ..... 2310554

(51) Int. Cl.[7] ..... B63B 1/24
(52) U.S. Cl. ..... 114/274; 114/291
(58) Field of Search ..... 114/271, 274, 114/291

(56) References Cited

U.S. PATENT DOCUMENTS 5,452,676 A * 9/1995 Fiore ..... 114/291
5,819,677 A * 10/1998 Livingston ..... 114/271
5,986,823 A * 11/1999 Allison ..... 114/271
6,000,357 A * 12/1999 Allison ..... 114/271
6,138,601 A * 10/2000 Anderson et al. ..... 114/385

* cited by examiner

*Primary Examiner*—Stephen Avila
(74) *Attorney, Agent, or Firm*—Davis & Bujold, P.L.L.C.

(57) ABSTRACT

A method of controlling the attitude of a boat at high speed through boat hull design involves a first step of forming a pair of high speed steps in the hull of the boat. The pair of high speed steps provide enough surface area to control ride attitude, while reducing the wetted area of the hull to decrease drag. A second step involves forming transition steps to provide a transition to the high speed steps as the boat accelerates. In addition to reducing drag, the method aids in turning and lifting of the hull by trapping air and water in the steps.

6 Claims, 3 Drawing Sheets

METHOD OF CONTROLLING THE ATTITUDE OF A BOAT AT HIGH SPEED THROUGH BOAT HULL DESIGN AND A BOAT HULL

FIELD OF THE INVENTION

The present invention relates to a method of controlling the attitude of a boat at high speed through boat hull design, and a boat hull constructed in accordance with the teachings of the method.

BACKGROUND OF THE INVENTION

It is generally accepted practice that the optimum attack angle of a powered planning hull to the water surface is approximately 2.5° to 3.0°. It has been found, however, that it is difficult to maintain an attack angle of between 2 and 3 degrees as a motor boat accelerates. This is particularly the case with motor boats powered by inboard jets, as the thrust line is higher than with motor boats powered by outboard motors. A lower thrust line allows greater leverage on the hull when trimming the drive to achieve the desired ride angle of the boat. The high thrust line of the jet is not nearly as effective in this regard because as the speed of a jet boat increases, hydrodynamic pressure builds near the stern making it difficult to maintain an effective planing attitude. This results in the hull running flat which creates a greater wetted surface area. The greater the wetted surface area of the hull, the more frictional water drag occurs resulting in poor handling and a loss of control of the boat.

SUMMARY OF THE INVENTION

What is required is a method of controlling the attitude of a boat at high speed through boat hull design, and a boat hull constructed in accordance with the teachings of the method.

According to one aspect of the present invention there is provided a method of controlling the attitude of a boat at high speed through boat hull design. A first step involves forming a pair of high speed steps in the hull of the boat adjacent to the stern on opposite sides of the keel between the chines to control the attitude of the boat at high speed. The length of the pair of high speed steps must be not less than 10% and not more than 30% of the length of the hull. The width of the each of the pair of high speed steps must be not less than 20% and not more than 40% of the chine to chine width of the hull. The depth of the each of the pair of high speed steps must be not less than 1% and not more than 5% of the chine to chine width of the hull. A second step involves forming at least one pair of transition steps in the hull of the boat adjacent to the pair of high speed steps on opposite sides of the keel and between the chines to provide a transition to the pair of high speed steps. The length of the pair of transition steps is not less than 10% and not more than 30% of the length of the hull. The width of the each of the pair of transition steps is not less than 20% and not more than 40% of the chine to chine width of the hull. The depth of the each of the at least one pair of transition steps being not less than 0.5% and not more than 2.5% of the chine to chine width of the hull.

According to another aspect of the present invention there is provided a boat hull that is constructed in accordance with the teachings of the present method.

With a boat hull constructed in accordance with the teachings of the above method, the wetted surface area of the boat is less at high speed, as will hereinafter be further described. This method also aids in turning and lifting of the hull by trapping air and water in the steps.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
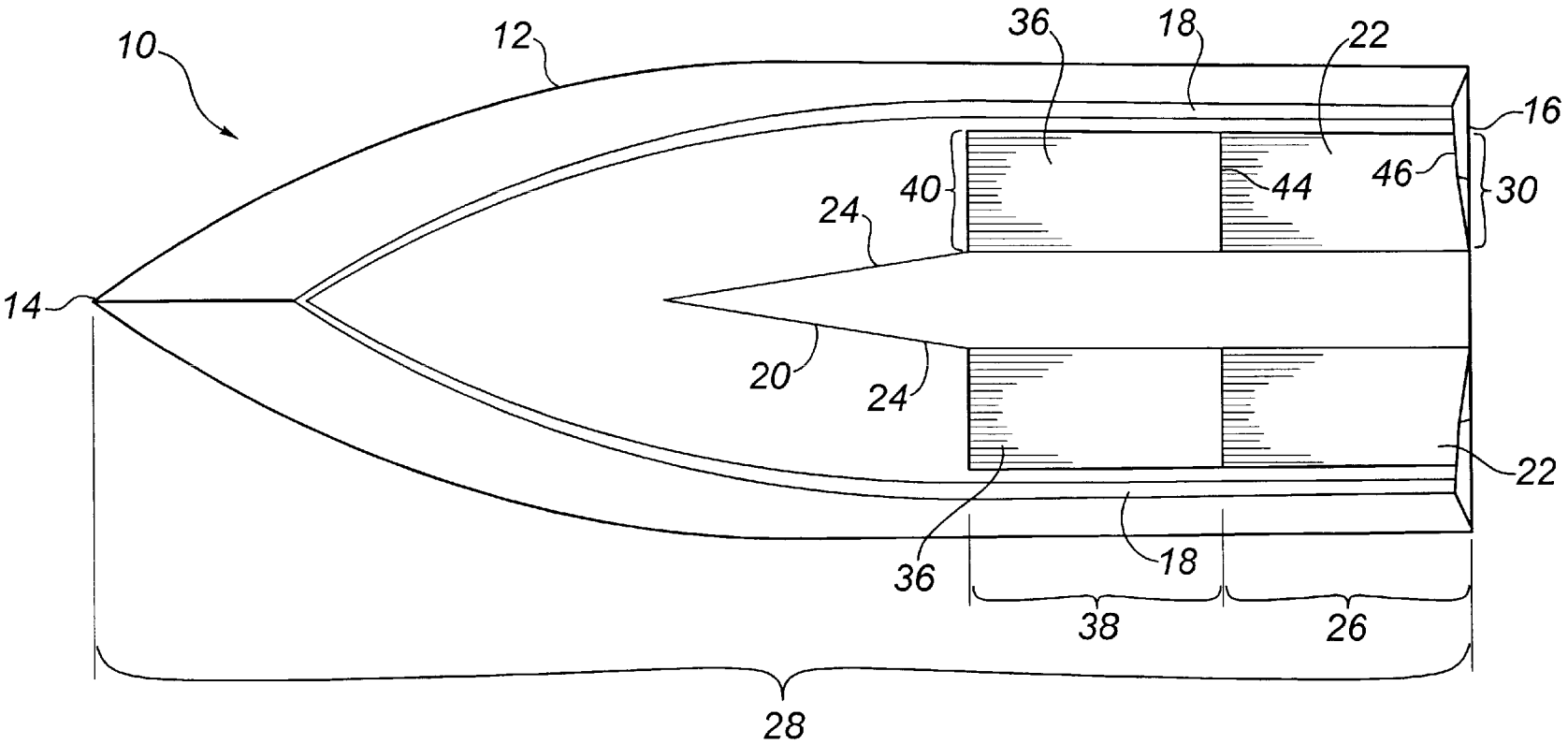
FIG. 1 is a bottom plan view of a boat hull constructed in accordance with the teachings of the present method.

The preferred embodiment, a boat hull generally identified by reference numeral 10, will now be described with reference to FIGS. 1 through 5.

This boat hull has been constructed in accordance with the teachings of the present method of controlling the attitude of a boat at high speed through boat hull design.

Referring to FIG. 1, there is provided a boat hull 10 of boat 12 with a bow 14 and a stern 16, chines 18, and a keel 20. Boat hull 10 is characterized by a pair of high speed steps 22 in hull 10 of boat 12 adjacent to stern 16 on opposed sides 24 of keel 20 and between chines 18 to control the attitude of boat 12 at high speed.

Figure 2:
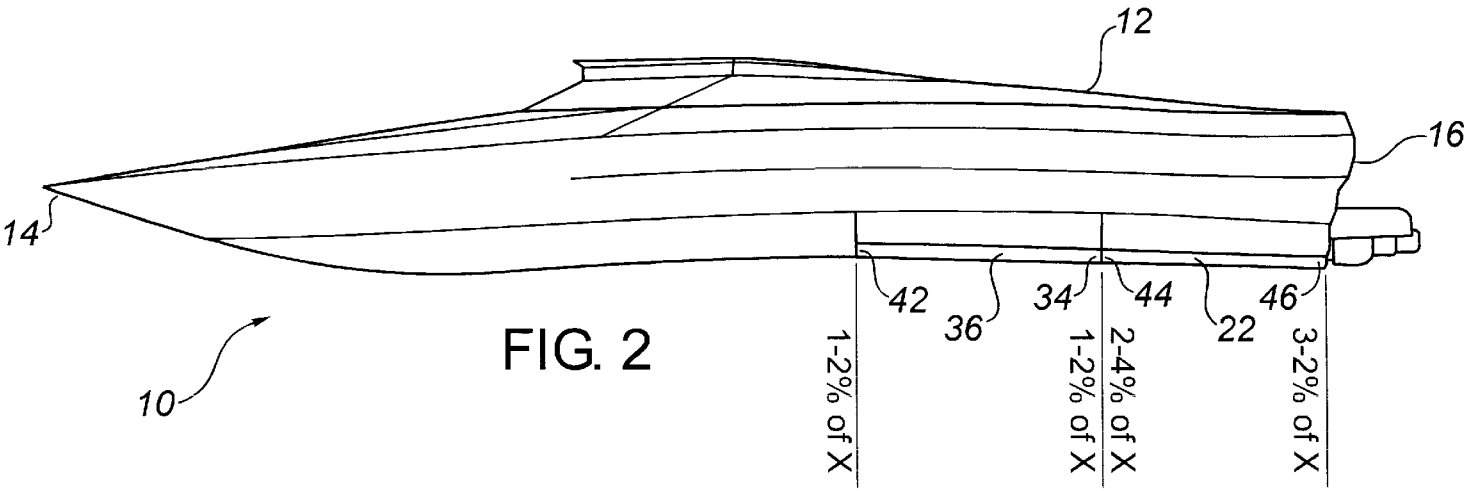
FIG. 2 is a side elevation view of the boat hull illustrated in FIG. 1.
Figure 3:
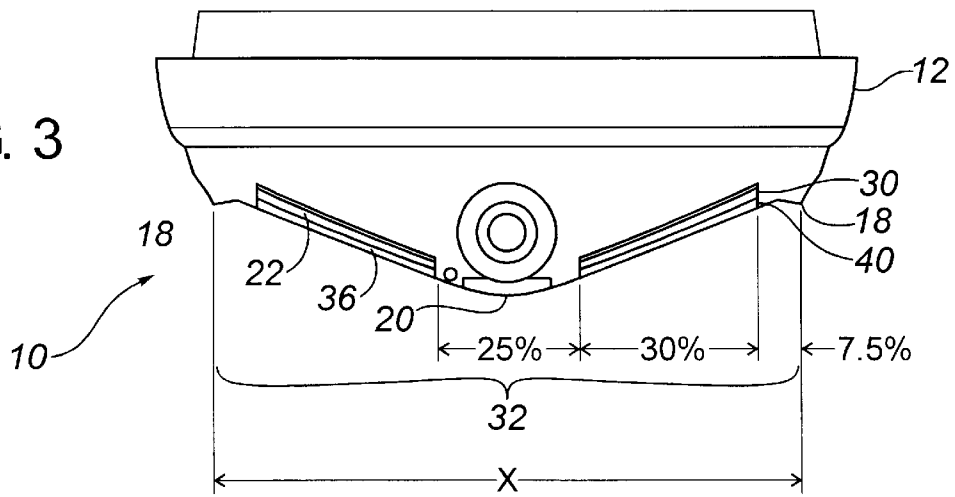
FIG. 3 is an end elevation view of the boat hull illustrated in FIG. 1.

The length 26 of pair of high speed steps 22 is not less than 10% and not more than 30% of the length 28 of hull 10. Referring to FIG. 3, the width 30 of each of pair of high speed steps 22 is not less than 20% and not more than 40% of chine to chine width 32 of hull 10. Referring to FIG. 2, depth 34 of each of pair of high speed steps 22 is not less than 1% and not more than 5% of chine to chine width 32 of hull 10. In FIGS. 1 and 3, this chine to chine width is identified as "X". In FIG. 2, the depth is indicated as a percentage of "X". Referring to FIG. 1, at least one pair of transition steps 36 are provided for in hull 10 of boat 12 adjacent to pair of high speed steps 22 on opposite sides 24 of keel 20 and between chines 18 to provide a transition to pair of high speed steps 22. Length 38 of pair of transition steps 36 is not less than 10% and not more than 30% of length 28 of hull 10.

Referring to FIG. 3, width 40 of each of pair of transition steps 36 is not less than 20% and not more than 40% of chine to chine width 32 of hull 10. Referring to FIG. 2, depth 42 of each of pair of transition steps 36 is not less than 0.5% and not more than 2.5% of chine to chine width 32 of hull 10.

Referring to FIG. 1, each of pair of high speed steps 22 has a bow end 44 and a stern end 46. Referring to FIG. 2, each of pair of high speed steps 22 increases in depth 34 from bow end 44 toward stern end 46. The angle is preferably between 0.5 and 2 degrees. A change in the angle has the effect of altering the amount of lift exerted upon boat 12. Beneficial results have been obtained with an angle of 0.75 of a degree.

Figure 4:
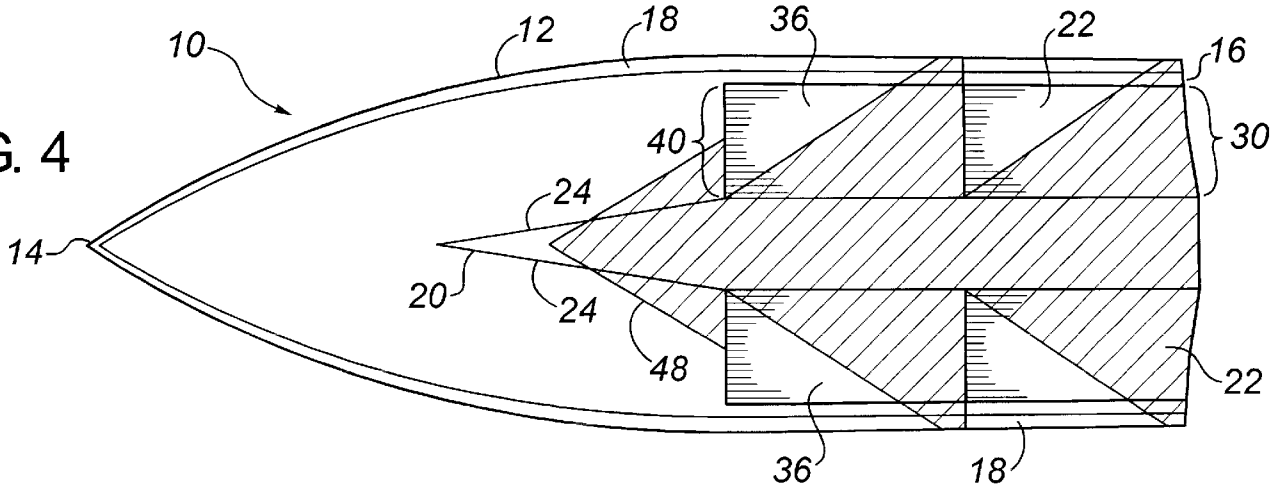
FIG. 4 is an bottom plan view of the boat hull illustrated in FIG. 1, showing wetted surface area at low speed.
Figure 5:
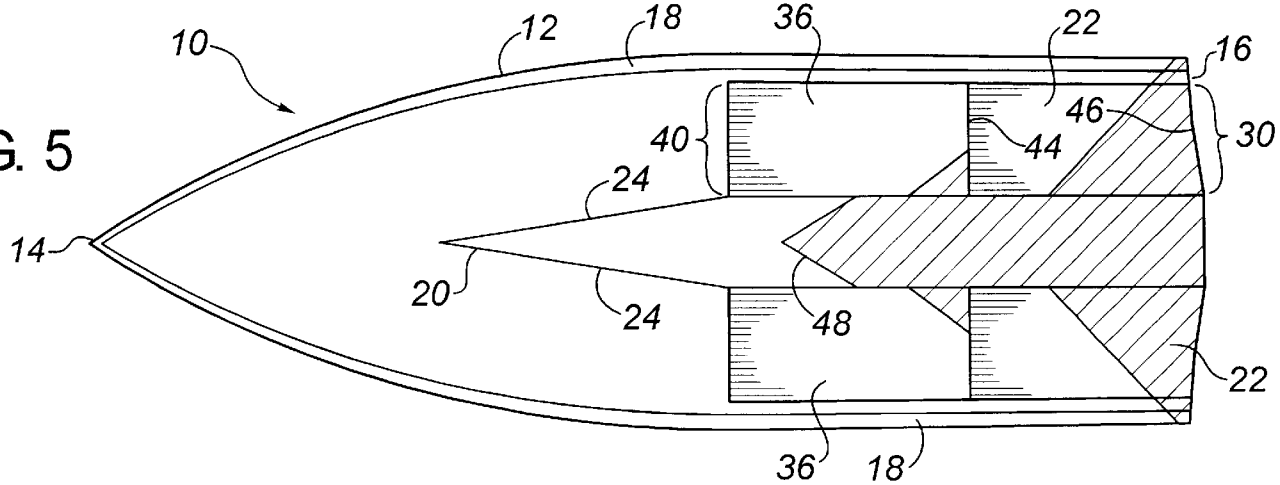
FIG. 5 is an bottom plan view of the boat hull illustrated in FIG. 1, showing wetted surface area at high speed.

Referring to FIG. 5, high speed steps 22 will not have enough surface area 48 to control the attitude of hull 10 if length 26 of high speed steps 22 is less than 10% of chine to chine width 32 of hull 10. Referring to FIG. 4, alternatively, there will be too much wetted surface area 48 which causes hull 10 to run flat and results in high frictional drag if length 26 of high speed steps 22 is more than 30% of chine to chine width 32 of hull 10. Widths 30 of high speed steps 22 that are less than 20% of chine to chine width 32 of hull 10 are too narrow to effectively control the attitude of hull 10. Widths 30 of more than 40% of chine to chine width 32 of hull 10 leave keel 20 too narrow to support the weight of hull 10 which results in high drag. Referring to FIG. 2, if depth 34 of high speed steps 22 is less than 1% of chine to chine width 32 of hull 10, it results in hull 10 having a high drag. High speed steps 22 of depth 34 of more than 5% of chine to chine width 32 of hull 10 make it difficult to for high speed steps 22 to maintain contact with the water surface resulting in a loss of attitude control.

Referring to FIG. 5, transition steps 36 will not have enough surface area 48 to control the attitude of hull 10 if length 38 of transition steps 36 is less than 10% of chine to chine width 32 of hull 10. Referring to FIG. 4, alternatively, there will be too much wetted surface area 48 which causes hull 10 to run flat and results in high frictional drag if length 38 of transition steps 36 is more than 30% of chine to chine width 32 of hull 10. Widths 40 of transition steps 36 that are less than 20% of chine to chine width 32 of hull 10 are too narrow to effectively control the attitude of hull 10. Widths 40 of more than 40% of chine to chine width 32 of hull 10 leave keel 20 too narrow to support the weight of hull 10 which results in high drag. FIG. 2, if depth 42 of transition steps 36 is less than 0.5% of chine to chine width 32 of hull 10, it results in hull 10 having a high drag. Transition steps 36 of depth 42 of more than 2.5% of chine to chine width 32 of hull 10 make it difficult to for transition steps 36 to maintain contact with the water surface resulting in a loss of attitude control.

While using the percentage range described above provides an improved ability to control the attitude of boat 12 at high speeds, more beneficial results are obtained by applying a narrower range of percentages. The benefit of the narrow range of percentages is that improved handling and control of the attitude of boat 12 at high speeds can be obtained. Using the narrower range of percentages results in less wetted surface area 48 on hull 10 of boat 12 resulting in less frictional drag yet allows for enough wetted surface area 48 for effective control of attitude of boat at high speeds. The narrower range of percentages will now be discussed with reference to FIGS. 1 through 5.

Referring to FIG. 1, the length 26 of each of pair of high speed steps 22 is not less than 14% and not more than 22% of length 28 of hull 10. Referring to FIG. 3 width 30 of each of pair of high speed steps 22 is not less than 26% and not more than 34% of chine to chine width 32 of hull 10. Referring to FIG. 2, depth 34 of each of pair of high speed steps 22 is not less than 2% and not more than 4% of chine to chine width 32 of the hull 10. Referring to FIG. 1, length 38 of each of pair of transition steps 36 is not less than 14% and not more than 22% of length 28 of the hull 10. Referring to FIG. 3, width 40 of each of pair of transition steps 36 is not less than 26% and not more than 34% of chine to chine width 32 of hull 10. Depth 42 of each of pair of transition steps 36 is not less than 1% and not more than 1.5% of chine to chine width 32 of hull 10.

With a boat hull constructed, as described, the wetted surface area of the boat is less at high speed. This results in less drag. However, the steps also aid in turning and lifting of the hull by trapping air and water in the steps.

Examples will now be describe to assist in the successful application of the teachings of the method.

EXAMPLE # 1

Recommended dimensions for boat 12 having:

a hull length 28 of 228 inches (19 feet)

a chine to chine hull width 32 of 63 inches

Length 26 of each high speed step 22 is not less than 10% of hull length 28 of 228 inches=22.8 inches and not more than 30% of hull length 28 of 228 inches=68.4 inches. Preferred is a narrower range of 14% of hull length 28 of 228 inches=31.92 and 22% of hull length 28 of 228 inches=50.16 inches. What is illustrated is 40 inches which is approximately 18%. Width 30 of each high speed step 22 is not less than 20% of hull width 32 of 63 inches=12.6 inches and not more than 40% of hull width 32 of 63 inches=25.2 inches. Preferred is a narrower range of 26% of hull width 32 of 63 inches=16.38 and 34% of hull width 32 of 63 inches=21.42 inches. What is illustrated is 18.9 inches which is approximately 30% depth 34 of each high speed step 22 is not less than 1% of hull width 32 of 63 inches=0.63 inches and not more than 5% of hull width 32 of 63 inches=3.15 inches. Preferred is a narrower range of 2% of hull width 32 of 63 inches=1.26 and 4% of hull width 32 of 63 inches=2.52 inches. What is illustrated is a slope which starts at bow end 44 at 1.5 inches which is approximately 2.4% and gradually increases in depth from bow end 44 toward stern end 46 to 2 inches which is approximately 3.2%.

Length 38 of each transition step 36 is not less than 10% of hull length 28 of 228 inches=22.8 inches and not more than 30% of hull length 28 of 228 inches=68.4 inches. The Preferred range is a narrower range of 14% of hull length 28 of 228 inches=31.92 and 22% of hull length 28 of 228 inches=50.16 inches. What is actually illustrated is 41 inches which is approximately 18% width 40 of each transition step 36 is not less than 20% of hull width 32 of 63 inches=12.6 inches and not more than 40% of hull width 32 of 63 inches=25.2 inches. Preferred is a narrower range of 26% of hull width 32 of 63 inches=16.38 and 34% of hull width 32 of 63 inches=21.42 inches. What is illustrated is 18.9 inches which is approximately 30% depth 42 of each transition step 36 is not less than 0.5% of hull width 32 of 63 inches=0.32 inches and not more than 2.5% of hull width 32 of 63 inches=1.58 inches. Preferred is a narrower range of 1% of hull width 32 of 63 inches=0.63 and 1.5% of hull width 32 of 63 inches=0.95 inches. What is illustrated is a 0.75 inches which is approximately 1.2%.

EXAMPLE # 2

Recommended dimensions for a boat 12 having:

a hull length 28 of 342 inches (28.5 feet)

a chine to chine hull width 32 of 94.5 inches

Length 26 of each high speed step 22 is not less than 10% of hull length 28 of 342 inches=34.2 inches and not more than 30% of hull length 28 of 342 inches=102.6 inches. Preferred is a narrower range of 14% of hull length 28 of 342 inches=47.88 and 22% of hull length 28 of 342 inches=75.24 inches. What is illustrated is 61.5 inches which is approximately 18% width 30 of each high speed step 22 is not less than 20% of hull width 32 of 94.5 inches=18.9 inches and not more than 40% of hull width 32 of 94.5 inches=37.8 inches. Preferred is a narrower range of 26% of hull width 32 of 94.5 inches=24.57 and 34% of hull width 32 of 94.5 inches=32.13 inches. What is illustrated is 28.35 inches which is approximately 30% depth 34 of each high speed step 22 is not less than 1% of hull width 32 of 94.5 inches=0.95 inches and not more than 5% of hull width 32 of 94.5 inches=4.73 inches. Preferred is a narrower range of 2% of hull width 32 of 94.5 inches=1.89 and 4% of hull width 32 of 63 inches=3.78 inches. What is illustrated is a slope which starts at bow end 44 at 2.25 inches which is approximately 2.4% and gradually increases in depth 42 from bow end 44 toward stern end 46 to 3 inches which is approximately 3.2%.

Length 38 of each transition step 36 is not less than 10% of hull length 28 of 342 inches=34.2 inches and not more than 30% of hull length 28 of 342 inches=102.6 inches. The preferred range is a narrower range of 14% of hull length 28 of 342 inches=47.88 and 22% of hull length 28 of 342 inches=75.24 inches. What is actually illustrated is 60 inches which is approximately 18% width 40 of each transition step 36 is not less than 20% of hull width 32 of 94.5 inches=18.9 inches and not more than 40% of hull width 32 of 94.5 inches =37.8 inches. Preferred is a narrower range of 26% of hull width 32 of 94.5 inches=24.57 and 34% of hull width 32 of 94.5 inches=32.13 inches. What is illustrated is 28.35 inches which is approximately 30% depth 42 of each transition step 36 is not less than 0.5% of hull width 32 of 94.5 inches =0.47 inches and not more than 2.5% of hull width 32 of 94.5 inches=2.36 inches. Preferred is a narrower range of 1% of hull width 32 of 94.5 inches=0.95 and 1.5% of hull width 32 of 94.5 inches=1.42 inches. What is illustrated is a 1.13 inches which is approximately 1.2%.

Where relative dimensions of the length of the hull have been provided above, it will be understood that trim tab, drives, swim platforms, etc. are not to be included in such calculations.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method of controlling the attitude of a boat at high speed through boat hull design, comprising the steps of:

forming a pair of high speed steps in the hull of the boat adjacent to the stern on opposite sides of the keel between the chines to control the attitude of the boat at high speed, the length of the pair of high speed steps being not less than 10% and not more than 30% of the length of the hull, the width of the each of the pair of high speed steps being not less than 20% and not more than 40% of the chine to chine width of the hull, the depth of the each of the pair of high speed steps being not less than 1% and not more than 5% of the chine to chine width of the hull; and forming at least one pair of transition steps in the hull of the boat adjacent to the pair of high speed steps on opposite sides of the keel and between the chines to provide a transition to the pair of high speed steps, the length of the at least one pair of transition steps being not less than 10% and not more than 30% of the length of the hull, the width of the each of the at least one pair of transition steps being not less than 20% and not more than 40% of the chine to chine width of the hull, the depth of the each of the at least one pair of transition steps being not less than 0.5% and not more than 2.5% of the chine to chine width of the hull.

2. The method as defined in claim 1, each of the pair of high speed steps having a bow end and a stern end, each of the pair of high speed steps increasing in depth from the bow end toward the stern end.

3. The method as defined in claim 1, the length pair of high speed steps being not less than 14% and not more than 22% of the length of the hull, the width of the each of the pair of high speed steps being not less than 26% and not more than 34% of the chine to chine width of the hull, the depth of the each of the pair of high speed steps being not less than 2% and not more than 4% of the chine to chine width of the hull; and the length of the at least one pair of transition steps being not less than 14% and not more than 22% of the length of the hull, the width of the each of the at least one pair of transition steps being not less than 26% and not more than 34% of the chine to chine width of the hull, the depth of the each of the at least one pair of transition steps being not less than 1% and not more than 1.5% of the chine to chine width of the hull.

4. A boat hull, characterized by:

a pair of high speed steps in the hull of the boat adjacent to the stern on opposed sides of the keel and between the chines to control the attitude of the boat at high speed, the length of the pair of high speed steps being not less than 10% and not more than 30% of the length of the hull, the width of the each of the pair of high speed steps being not less than 20% and not more than 40% of the chine to chine width of the hull, the depth of the each of the pair of high speed steps being not less than 1% and not more than 5% of the chine to chine width of the hull; and at least one pair of transition steps in the hull of the boat adjacent to the pair of high speed steps on opposite sides of the keel and between the chines to provide a transition to the pair of high speed steps, the length of the at least one pair of transition steps being not less than 10% and not more than 30% of the length of the hull, the width of the each of the at least one pair of transition steps being not less than 20% and not more than 40% of the chine to chine width of the hull, the depth of the each of the at least one pair of transition steps being not less than 0.5% and not more than 2.5% of the chine to chine width of the hull.

5. The boat hull as defined in claim 4, wherein each of the pair of high speed steps has a bow end and a stern end, each of the pair of high speed steps increasing in depth from the bow end toward the stern end.

6. The boat hull as defined in claim 4, wherein the length pair of high speed steps being not less than 14% and not more than 22% of the length of the hull, the width of the each of the pair of high speed steps being not less than 26% and not more than 34% of the chine to chine width of the hull, the depth of the each of the pair of high speed steps being not less than 2% and not more than 4% of the chine to chine width of the hull; and the length of the at least one pair of transition steps being not less than 14% and not more than 22% of the length of the hull, the width of the each of the at least one pair of transition steps being not less than 26% and not more than 34% of the chine to chine width of the hull, the depth of the each of the at least one pair of transition steps being not less than 1% and not more than 1.5% of the chine to chine width of the hull.

* * * * *